United States Patent [19]

Knouse

[11] Patent Number: 4,868,938

[45] Date of Patent: Sep. 26, 1989

[54] PATIENT MOVING METHOD

[76] Inventor: Bobby W. Knouse, 1253 Seacliff #7, Ventura, Calif. 93003

[21] Appl. No.: 192,140

[22] Filed: May 10, 1988

Related U.S. Application Data

[62] Division of Ser. No. 897,125, Aug. 15, 1986, Pat. No. 4,747,170.

[51] Int. Cl.[4] ..... A61G 7/10

[52] U.S. Cl. ..... 5/81 B

[58] Field of Search ..... 5/81 R, 81 B, 81 L, 5/488; 414/921; 24/459–462

[56] References Cited

U.S. PATENT DOCUMENTS

| | | | |
|---|---|---|---|
| 2,498,853 | 2/1950 | Hassold et al. | 5/81 B |
| 2,665,432 | 1/1954 | Butler | 5/81 B |
| 2,733,452 | 2/1956 | Tanney | 5/81 B |
| 2,812,524 | 11/1957 | Pruitt | 5/81 R X |
| 2,826,766 | 3/1958 | Stoner . | |
| 2,827,642 | 3/1958 | Huff | 5/81 B |
| 2,959,792 | 11/1960 | Haugard | 5/81 R X |
| 3,317,928 | 5/1967 | Root | 5/81 R X |
| 3,757,359 | 9/1973 | Stellman | 5/81 C |
| 3,761,153 | 9/1956 | Mew | 5/82 X |
| 3,875,623 | 4/1975 | Johnston | 24/207 |
| 4,011,609 | 3/1977 | Bethlen | 5/81 B |
| 4,077,073 | 3/1978 | Koll et al. | 5/81 R |
| 4,195,375 | 4/1980 | Paul | 5/81 R |

FOREIGN PATENT DOCUMENTS

| | | | |
|---|---|---|---|
| 243983 | 12/1965 | Austria | 5/81 B |
| 2257572 | 5/1974 | Fed. Rep. of Germany | 24/460 |
| 2308436 | 8/1974 | Fed. Rep. of Germany | 24/460 |
| 1512074 | 12/1967 | France | 5/81 R |
| 420697 | 12/1934 | United Kingdom | 24/72.5 |

*Primary Examiner*—Alexander Grosz

*Attorney, Agent, or Firm*—Jacobs, Marvin E.

[57] ABSTRACT

A heavy object such as a patient is moved laterally from a first surface such as a bed onto a second surface such as a gurney by the patient mover of the invention. The patient mover is positioned on the far side of the gurney. It operates by unwinding a web from a roller rotatably supported on an upstanding frame mounted on a wheeled stand until the web covers the mattress on the gurney and is adjacent the edge of the bed. The edge of the sheet adjacent the web is removed from under the mattress and is inserted through the slot of a tube attached to the web into the bore of the tube. The sheet is locked into the tube by inserting a rod into the bore of the tube. The web is rewound onto the roller and slowly pulls the sheet carrying the patient onto the gurney. The edge of the sheet is then released by removing the rod from the bore.

3 Claims, 6 Drawing Sheets

PATIENT MOVING METHOD

This is a Division of application Ser. No. 897,125, filed Aug. 15, 1986, now U.S. Pat. No. 4,747,170.

DESCRIPTION

Background of the Invention

The present invention relates to a device for moving a patient from one surface to another surface and, more particularly, the present invention relates to a device for transferring a patient from a hospital bed to another hospital bed or to a gurney.

Medical care has become very expensive. One of the major expenses in the cost of personnel, especially in hospitals. Patients are transferred many times during their stay in hospitals for reasons such as moving to a new room, to an analytical laboratory, blood testing or X-Ray facility, or for surgery. Non-ambulatory patients require use of a wheel chair or a gurney. Presently, in order to transfer a patient from a bed to a gurney, several personnel are required to either physically lift the patient onto a gurney or to move the patient laterally by pulling his or her sheet onto a gurney. This procedure, especially for a heavy patient weighing 200 to 400 pounds, is time consuming, difficult, and ties up several personnel for several minutes. These personnel must leave other duties unattended at the time. This also increases the staffing requirements of a hospital. Furthermore, many times it is difficult to move an injured patient by these procedures without causing discomfort, pain or injury.

Description of the Prior Art

Prior devices are not capable of simply transferring a patient to a gurney, utilizing the efforts of only a single hospital employee. U.S. Pat. No. 1,334,901 (Highdon), U.S. Pat. No. 2,812,524 to Pruett, U.S. Pat. No. 3,330,219 to Harris, and U.S. Pat. No. 4,536,903 to Parker all disclose patient-turning devices, not a device for transferring a patient from a bed to a gurney. Such devices use a roller which grips an edge of a bed sheet to turn the patient. U.S. Pat. No. 3,403,411 to Stineman et al and U.S. Pat. No. 4,012,799 to Rutherford disclose patient transfer devices which effect the transfer of a patient from one bed to another by use of a movable but solid member which contacts the patient and moves the patient onto the second bed. These devices require substantial strength to operate and place rigid members in contact with the patient's body which are capable of bruising or hurting a patient, especially a patient who has been non-ambulatory for a substantial period.

Statement of the Invention

A safe and effective patient transfer system is provided in accordance with the invention. The patient mover of the invention is a compact, stable unit that is readily movable into position by a single person, even a small and frail person, and can be quickly and efficiently operated to move the patient from one surface to another, such as from a bed to a gurney or vice versa. The patient transfer operation is effected in complete comfort and safety to the patient. The compact, low profile patient mover is readily moved into position with the stand or feet of the device under a bed or gurney with the upright frame adjacent the side of a bed or a gurney. The patient mover is so configured to cooperate with the bed to form a stable assembly during a patient transfer operation. Single personnel can operate the device and transfer the patient without the aid of any other person. The patient mover can then be simply rolled out of position away from the bed, and the personnel can proceed with moving the patient to the desired location on a gurney or securing the patient in the bed, or dress the bed for the patient (whichever is required).

In the invention, a load carried on a sheet of material is moved laterally by continuously engaging a substantial portion of an edge of the sheet with a rigid clamping means and then applying a lateral pulling force to the clamping means. The clamping means could be pulled by a screw drive, pneumatic drive, or any other motor device. A simple clamp is provided by a motor drive roller connected to a web.

A specific embodiment of the patient mover includes, in combination, a bottom stand member and an upstanding support frame carrying an elongated roller. Means for rotating the roller is attached to one end of the roller. The rotating means can be a mechanical member, such as a handle or an electric motor with suitable gearing and control devices for the motor, such as a speed controller and on/off switch. A first edge of a web-like sheet material such as canvas is attached to the roller. The outer edge of the web material contains means for gripping or attaching the web to a sheet. The preferred form of the attaching means extends along the length of the sheet so that it provides sufficient gripping surface without tearing the sheet at specific locations. The gripping means is an elongated rigid member. This provides even movement of the patient from head to toe rather than dragging the feet or the head of the patient first at an angle. This is very important in the movement of patients with injuries such as spinal, neck or limb fractures. In the preferred embodiment of the invention, the sheet gripping means comprises a slotted tube having a central bore and a rod insertable into the bore. The edge of the sheet adjacent to the gripping means is placed within the slot. The rod is then inserted into the central bore in the tube to form a very strong, efficient clamp along an extended portion of the edge of the sheet. When the patient has been moved onto the second bed, the rod is pulled out of the tube, and the edge of the sheet disengaged.

The patient mover of the invention may have other features such as wheels attached to the bottom stand member for moving the device readily into and out of position under a bed. The height of the upstanding frame member can be adjustable so that the web and roller assembly are or can be positioned at or near the same height as the mattress on the bed and gurney during the transfer operation. Bumpers may be provided on the inner surfaces of the horizontal braces of the stand at a height and position to engage bumpers or beam members on a gurney or a bed. The bumpers can be positioned against opposed bumpers or against the frame or the spring of the gurney or the bed during transfer. The patient mover device may tend to tilt during transfer due to the load placed on it during lateral pulling of a heavy patient. To prevent the device from tipping, adjustable arms may be mounted on the upstanding frame members which can be deployed over or under horizontal structural members facing it on the gurney or bed to minimize tilting and to stabilize the patient mover during transfer.

The patient mover is operated by rolling the bottom stand of the device underneath a gurney. The gurney is placed adjacent to a bed containing a patient. The motor is actuated or the handle rotated or unfurl the web member and position the outer edge of the web containing the gripping tube next to the edge of the sheet of the bed containing the patient. The edge of the sheet is removed from under the mattress and the rod is removed from the bore of the tube. The edge of the sheet is inserted into the slot in the tube, and then the rod is pushed into one end of the bore in the tube. The rod carries the sheet edge down the bore and seats the sheet along the length of the tube to form a reliable, safe and effective clamping connection between the web and the sheet. The direction of rotation of the motor or the handle is then reversed and operated at slow speed, suitably below 50 r.p.m. The sheet is slowly retracted onto the roller and as the web pulls across the gurney, the trailing, connected sheet containing the patient is slowly pulled onto the gurney in an even and parallel disposition. When the patient is centered onto the gurney, the motor is stopped and the rod is pulled out of the tube to release the sheet. The patient mover is then moved out of position away from the gurney.

These and many other features and attendant advantages of the invention will become apparent as the invention becomes better understood by reference to the following detailed description when considered in conjunction with the accompanying drawings.

Figure 1:
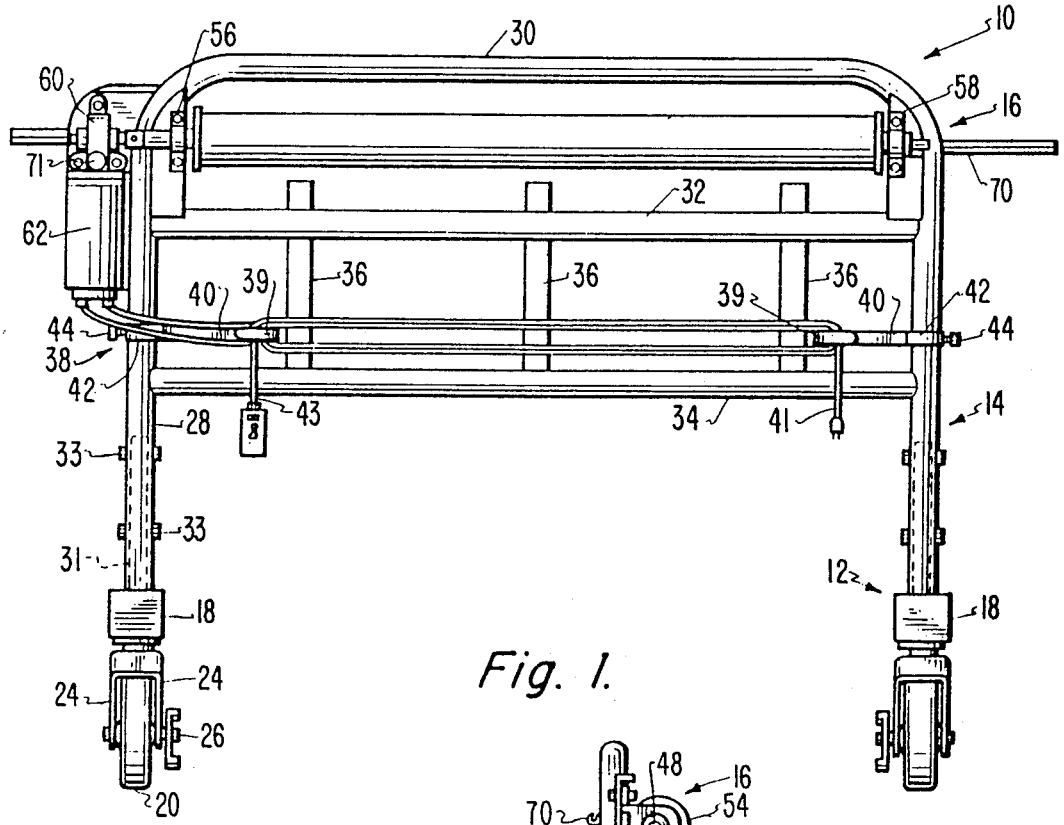
FIG. 1 is a front view in elevation of the patient mover of this invention.
Figure 2:
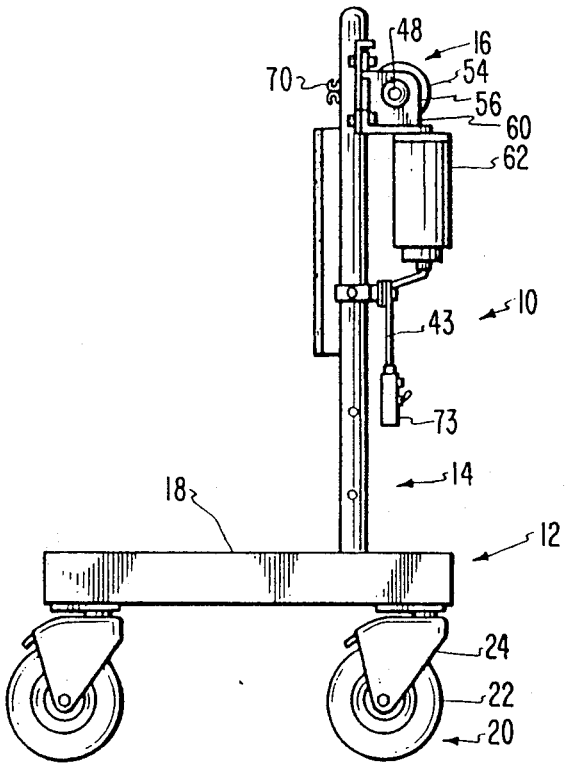
FIG. 2 is a side view in elevation of the patient mover of the invention.
Figure 3:
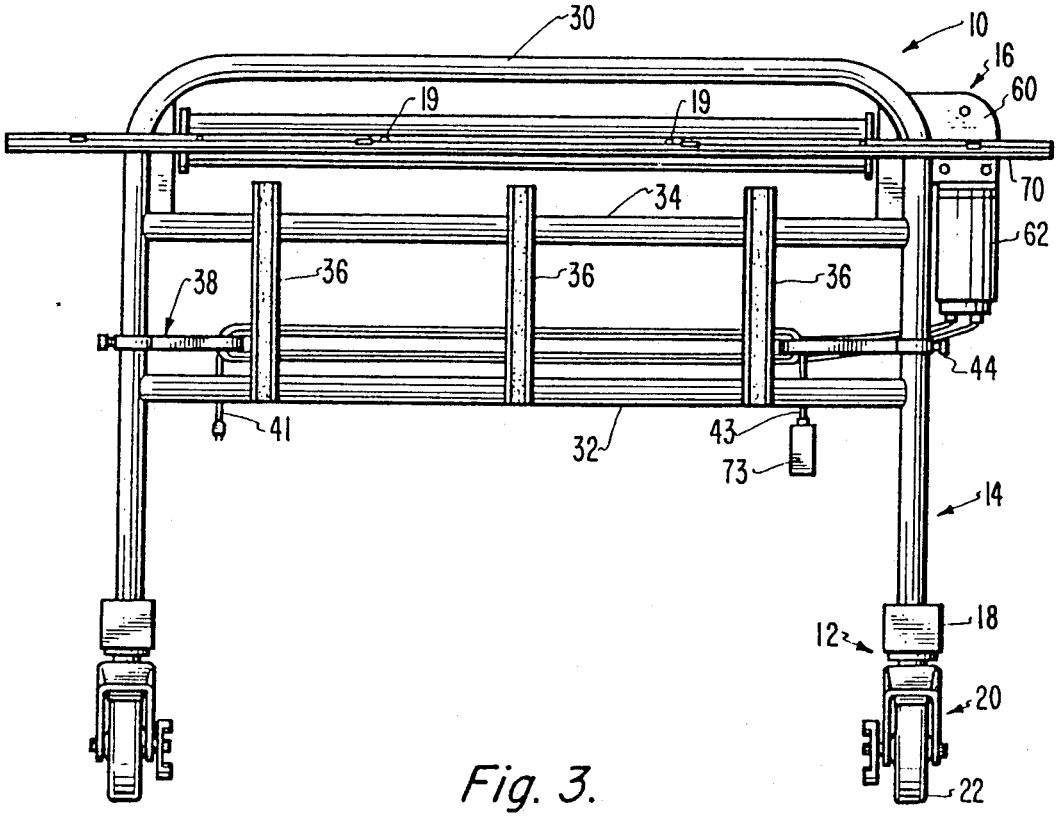
FIG. 3 is a rear view in elevation of the patient mover of the invention.
Figure 4:
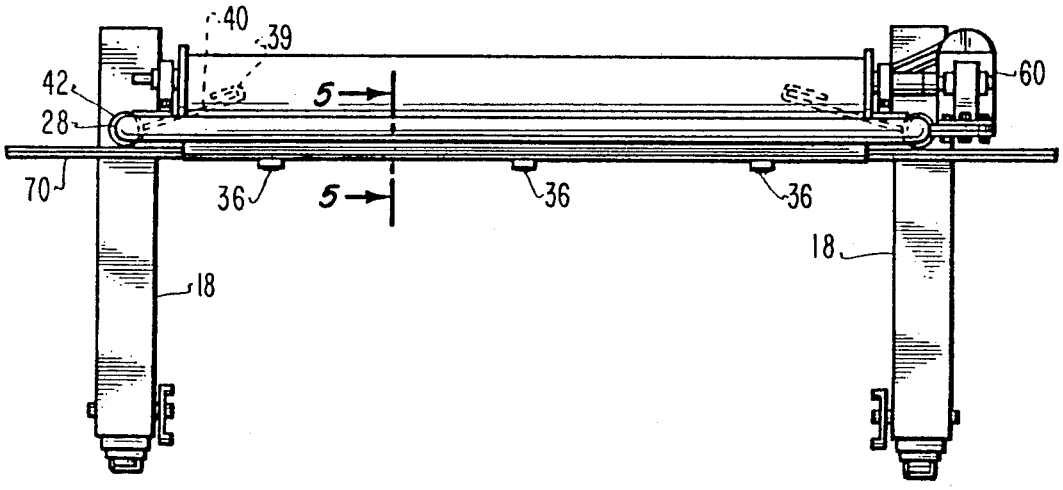
FIG. 4 is a top view in elevation of the patient mover.

FIGS. *7a* to *7g* are plan views showing operation of the patient mover to move a patient from a bed onto an adjacent gurney.

DETAILED DESCRIPTION OF THE INVENTION

Referring now to FIGS. 1–4, the patient mover 10 of the invention comprises in combination a horizontal stand 12 which acts as a base for an upstanding frame 14 which carries the roller assembly 16. The horizontal stand 12 may be comprised of two metal tubular members 18 which can be of circular or square or other cross-section. In order to facilitate movement of the patient mover readily from place to place, a set of four wheels, casters or rollers may be attached to the bottom of the horizontal tubular members 18. Preferably standard rollers 20 comprising a wheel 22 carried between a set of shafts 24 on an axle 26 depend from a mounting assembly carrying a pin. Frame 14 can be braced by two horizontal cross members 32, 34 which are attached to the vertical side legs 28. A set of vertical padded bumpers 36 may be attached to the cross members 32 and 34. The cross members 32 and 34 and the bumpers are so located so as to be opposite a bracing member on a bed or gurney such as the spring or cross brace of the gurney to bed. To further stabilize and support the patient mover 10 during use, a pair of bracing members 38 can be provided. The bracing member 38 are positioned underneath a cross brace of the opposed bed or gurney and contain an arm 40 which can be locked into position in that location. The outer end of each arm 40 can be bent to provide a set of opposed hooks 39 which can be utilized to carry the power cord 41 and the remote controller cord 43. Suitably the braces 38 have a collar 42 attached to the arm 40 and can ride up and down the vertical legs 28 of the frame 14. A locking screw 44 such as a thumb screw is utilized to lock the arms 40 underneath the opposed spring or structural member, and also after release of the thumb screw 44 to rotate the arms back under the bottom brace 34 so that they are safely out of position when the patient mover is not in use and do not impale or harm somebody accidentally. Curving the end of the arms with the hook also reduces risk of injury to personnel. The controller cord 43 and the power cord may be wound on rectractable reels, not shown.

The dimensions of the patient mover are not critical. However, it is important that the web have a minimum width in order to apply an even pulling force across a long length of the sheet edge. While pulling tension is localized by a series of clamps, the sheet tends to rip and tear. Therefore, the roller and belt width should be at least 2 and ½ feet, preferably at least 4 feet. Further tests have shown that for large loads, such as persons exceeding 200 pounds, the device works better if the gripping surface is further increased up to at least 5 feet, preferably 6 to 7 feet. This can be accomplished by using a longer rod on a smaller web, such as a 4 foot web containing a 6 foot rod.

Referring again to FIGS. 1–4 of the drawings, the roller assembly 16 comprises an axle 48 having a slot, not shown, in which is inserted the rearward edge of the web 54. The axle is rotatably received in bearings 56, 58 which are mounted in the upstanding legs 28 of the frame 14. One end of the axle is received in the gear reduction box 60 which in turn is connected to the electric motor 62. The motor 62 contains an on-off switch 67, a forward-reverse switch 64 and a speed controller knob 71. The forward-reverse switch 64 and the on-off switch 67 may be mounted on the motor or frame. It is preferred to mount the switches 64, 67 on a remote, handheld controller 73 connected to the motor 62 by a flexible cable 43 as shown in FIG. *7a*.

Figure 5:
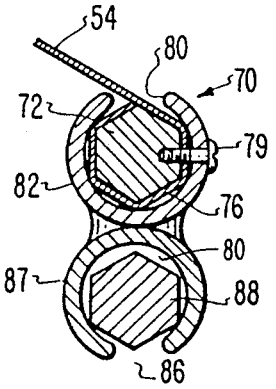
FIG. 5 is a cross-sectional view taken along line 5—5 of FIG. 4.
Figure 6:
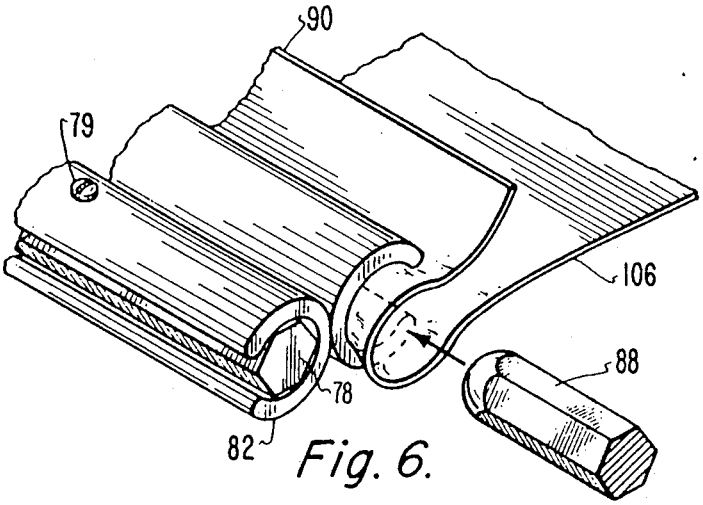
FIG. 6 is a partial view in perspective showing insertion of a sheet into the sheet gripping means.
Figure 7A:
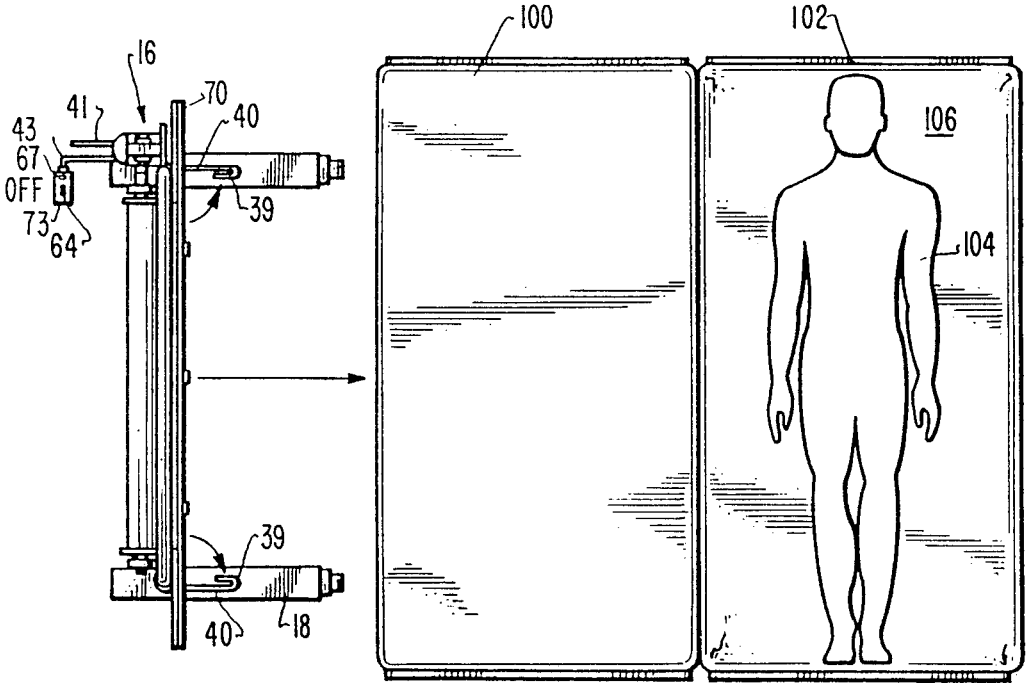
Figure 7B:
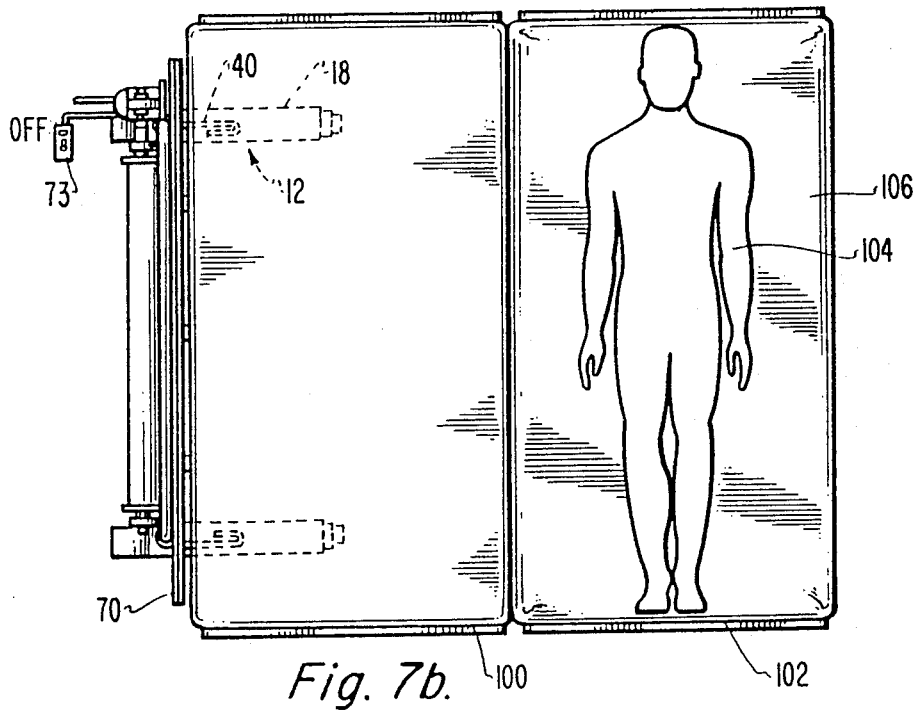
Figure 7C:
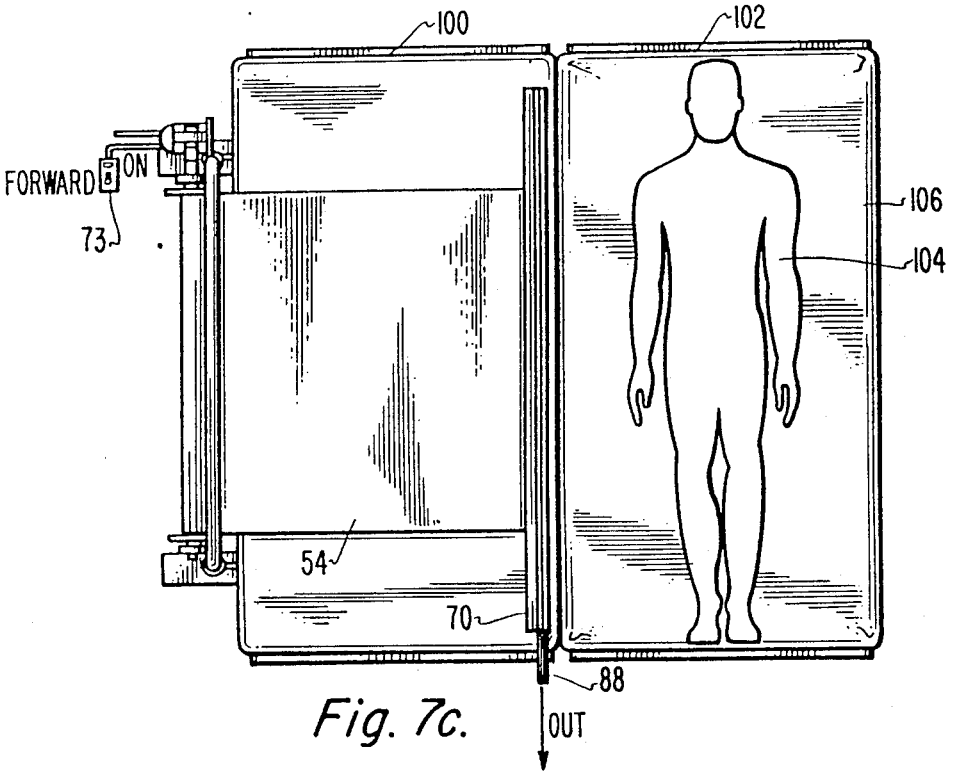
Figure 7D:
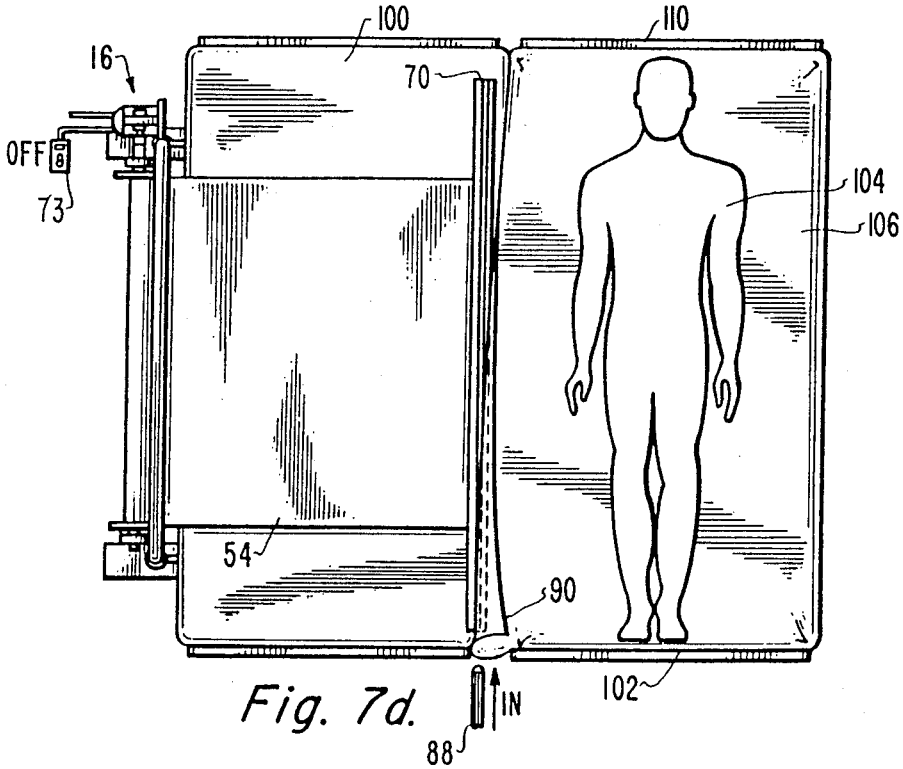
Figure 7E:
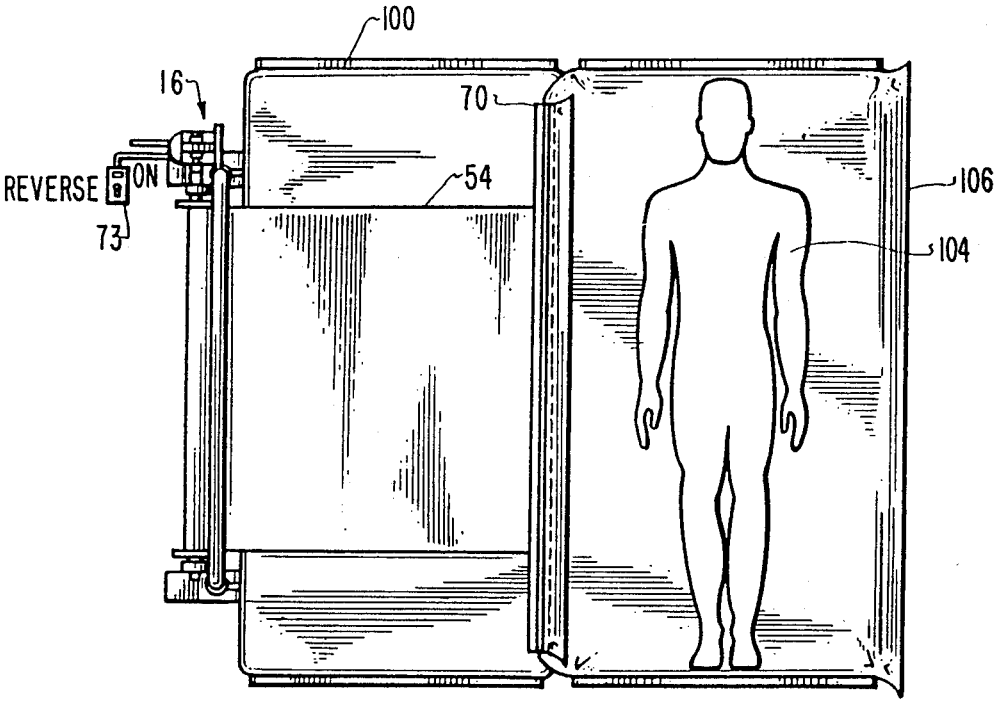
Figure 7F:
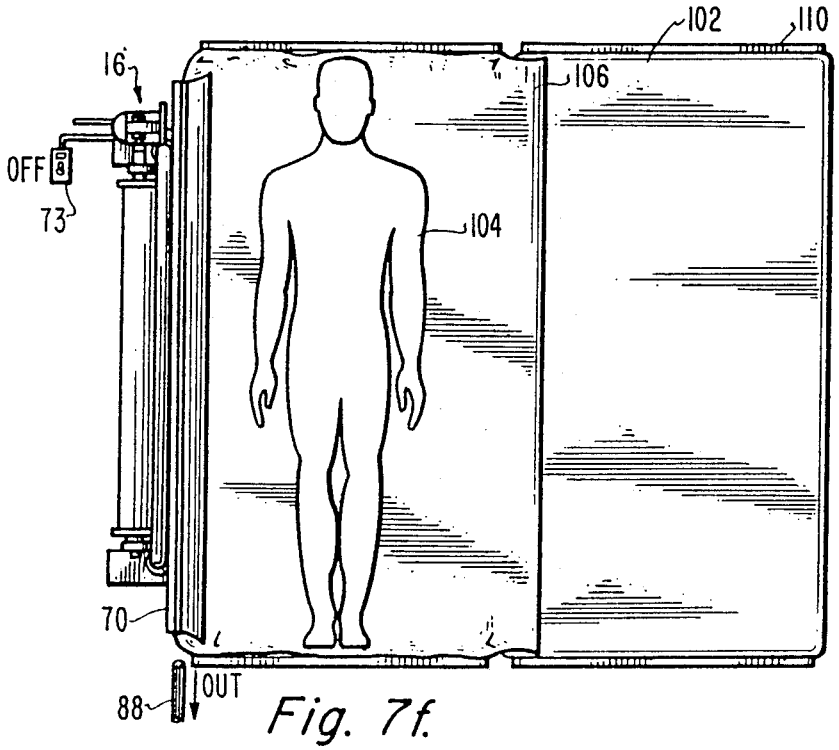
Figure 7G:
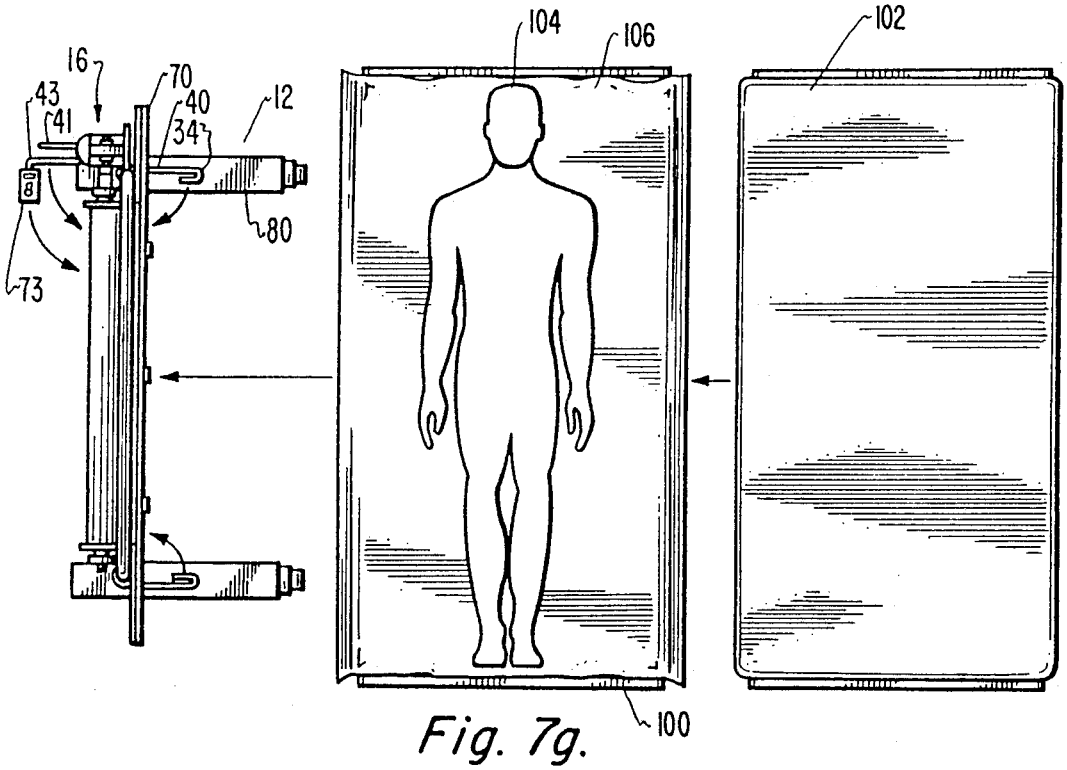

As shown in FIGS. 5 and 6, the web 54 is at least 2 and ½ feet wide, suitably 4 feet wide, and typically is at least 4 feet in length so that it can travel across the bed or gurney to the bed or gurney containing the patient. The gripping means 70 attached to the outer edge 72 of the web can take many configurations such as a set of clips riveted to the edge 72 of the web or can take the form of a strip hoop and loop type fastener, such as the ones sold under the trademark of Velcro connected to a mating strip on the edge of the sheet 106. Various other snaps or like connectors may also be utilized. However, most of these connectors cause the sheet to tear or require adaptation of the sheets to special requirements of the fastener. The novel gripping assembly of the invention is simple to use, does not tear sheets and effectively grips sheets without modification of the sheet. The gripping assembly 70 of the invention can comprise two slotted hollow tubes having central cylindrical bores welded together. The edge 72 of the web 54 is stitched over to form a sleeve 76. A rod 78 having a circular or polygonal cross-section is inserted into the sleeve 76. The sleeve 76 is then inserted into the central bore 80 in the tube 82 to connect the sheet-gripping tube 82 to the web 54. Threaded bolts 79 are threaded through the web to lock the web securely in the central bore 80. The other tube 87 contains a removable rod 88 which again can have a circular or polygonal cross-section. To grip the sheet 106, the rod 88 is removed and the edge 90 of the sheet is inserted into the slot 86. The rod 88 is replaced to form a stable, reliable attachment to the edge of the sheet.

The use of patient mover 10 of the invention is illustrated in FIGS. *7a* to *7g*. A gurney 100 is rolled adjacent a bed 102 carrying a patient 104 resting on a sheet 106. The cords 41, 43 are removed from the hooks 39 on the arms 40 and set screws 44 are released to adjust the height and forward direction of the arms 40. The screws 44 are then retightened. The edge 90 of the sheet is released from under the mattress 110. The patient mover 10 is then rolled to place the stand 12 under the gurney 100 with the roller assembly 16 facing the patient 104. The on switch 67 on the controller 73 is actuated and the web 54 is unfurled until the gripping assembly 70 is adjacent the edge 90 of the sheet. The rod 88 is removed from the tube 87 and the edge 90 of the sheet is inserted at the beginning of the slot 86. The rod 88 is then pushed into the opening in the tube until it carries the sheet edge with it down the central bore and seats and locks the sheet into the slot. The direction of rotation of the web is then reversed by pressing the reverse switch 64 on the controller and reactuating the motor by means of the switch 67. The web retracts and slowly and evenly pulls the sheet 106 carrying the patient 104 from the bed 102 onto the gurney 100. When the patient 104 is centered on the gurney 100, the off switch 67 is pulsed to turn the motor 62 off. The rod 88 is then pulled out of the gripping means 70 to release the sheet. The patient mover 10 is then rolled away and the gurney 100 containing the patient is ready to be moved to its new location.

Many other variations are possible such as different types of configurations of frame members and stand members. The gripping means can be any device that will evenly attach to a sheet and pull a heavy weight without gripping the edge of the sheet. The motor can be replaced by a handle or any other device capable of rotating the axle of the roller to wind the web.

It is to be realized that only preferred embodiments of the invention have been described, and that numerous substitutions, alterations and modifications are permissible without departing from the spirit and scope of the invention as defined in the following claims.

I claim:

1. A method of moving a patient resting on a sheet of material covering a first generally horizontal surface to a second generally horizontal surface comprising the steps of:

placing the second surface adjacent to the first surface;

positioning a roller supporting structure adjacent the second surface, said roller supporting structure rotatably supporting an elongated roller and a web that is adapted to be wound on said roller, said web having first and second parallel to edges, the first edge being connected to said roller;

connecting the second edge of the web to a sheet gripping means comprising at least one, slotted tube, said tube having a cylindrical bore communicating with said slot;

inserting an edge portion of the patient supporting sheet through said slot into the bore;

locking the edge portion of the sheet into the bore with an elongated rod that has a polygonal cross section and is adapted to securely and frictionally hold the edge of the sheet in said bore; and rotating the roller, thereby winding the web onto the roller and pulling the patient supporting sheet from the first surface to the second surface.

2. The method of claim 1, wherein the sheet gripping means is at least two and one-half feet long.

3. The method of claim 1, wherein the sheet gripping means comprises two parallel adjacent slotted tubes, each tube having a cylindrical bore, and the second edge of the web is connected into the bore of the slotted tube adjacent the bore into which the patient supporting means is connected.

* * * * *